US009151142B2

(12) United States Patent
Pei et al.

(10) Patent No.: US 9,151,142 B2
(45) Date of Patent: Oct. 6, 2015

(54) SEGMENTAL FLOW CONTROL METHOD AND APPARATUS FOR A FLOW CONTROL FILTER STRING IN AN OIL-GAS WELL

(75) Inventors: Bailin Pei, Beijing (CN); Jianchang Wu, Beijing (CN)

(73) Assignee: Anton Bailin Oilfield Technologies (Beijing) Co., Ltd., Beijing (CN)

( * ) Notice: Subject to any disclaimer, the term of this patent is extended or adjusted under 35 U.S.C. 154(b) by 410 days.

(21) Appl. No.: 13/514,833

(22) PCT Filed: Dec. 10, 2010

(86) PCT No.: PCT/CN2010/002016
§ 371 (c)(1), (2), (4) Date: Jun. 22, 2012

(87) PCT Pub. No.: WO2011/069341
PCT Pub. Date: Jun. 16, 2011

(65) Prior Publication Data

US 2012/0273196 A1 Nov. 1, 2012

(30) Foreign Application Priority Data

Dec. 11, 2009 (CN) ..... 2009 1 0250792

(51) Int. Cl.

| | |
|---|---|
| ***E21B 43/18*** | (2006.01) |
| ***E21B 43/02*** | (2006.01) |
| ***E21B 43/08*** | (2006.01) |
| *E21B 43/04* | (2006.01) |

(52) U.S. Cl.
CPC ..... *E21B 43/08* (2013.01); *E21B 43/02* (2013.01); *E21B 43/04* (2013.01)

(58) Field of Classification Search
CPC ..... E21B 43/08; E21B 43/02; E03B 3/18
USPC ..... 166/278, 276, 279
See application file for complete search history.

(56) References Cited

U.S. PATENT DOCUMENTS

| | | | | |
|---|---|---|---|---|
| 3,302,719 | A * | 2/1967 | Fischer | 166/280.2 |
| 3,481,401 | A * | 12/1969 | Graham | 166/280.2 |
| 4,750,561 | A * | 6/1988 | Dickinson et al. | 166/278 |
| 5,343,953 | A * | 9/1994 | Patel et al. | 166/312 |
| 6,059,034 | A * | 5/2000 | Rickards et al. | 166/280.2 |
| 6,719,064 | B2 * | 4/2004 | Price-Smith et al. | 166/387 |

(Continued)

FOREIGN PATENT DOCUMENTS

| | | |
|---|---|---|
| WO | 2005078235 | 8/2005 |
| WO | 2007140820 | 12/2007 |

*Primary Examiner* — Angela M DiTrani
*Assistant Examiner* — Silvana Runyan
(74) *Attorney, Agent, or Firm* — Scheinberg & Associates, PC; John B. Kelly; Michael O. Scheinberg

(57) ABSTRACT

An oil-gas well structure and a segmental flow-control method for a flow-control filter string (5) used in the oil-gas well. The segmental flow-control method for the flow-control filter string (5) comprises the following steps: 1) establishing a channel (2-1); 2) running the flow-control filter string (5); 3) filling with the anti-channeling flow pack-off particles (7); 4) sealing; 5) disconnecting a run-in string connected to the flow-control filter string (5). The segment flow control of the flow-control filter string (5) is achieved by using a pack-off effect of the anti-channeling flow pack-off particles (7).

40 Claims, 4 Drawing Sheets

(56) References Cited

U.S. PATENT DOCUMENTS

| | | | | |
|---|---|---|---|---|
| 7,426,961 | B2 * | 9/2008 | Stephenson et al. | 166/280.2 |
| 2002/0066560 | A1 * | 6/2002 | Dusterhoft et al. | 166/236 |
| 2002/0189809 | A1 * | 12/2002 | Nguyen et al. | 166/278 |
| 2005/0056425 | A1 | 3/2005 | Grigsby et al. | |
| 2008/0217002 | A1 * | 9/2008 | Simonds et al. | 166/230 |
| 2009/0188569 | A1 | 7/2009 | Saltel | |

* cited by examiner

SEGMENTAL FLOW CONTROL METHOD AND APPARATUS FOR A FLOW CONTROL FILTER STRING IN AN OIL-GAS WELL

TECHNICAL FIELD

The present invention relates to technologies in the field of development of an oil-gas well and particularly to a segmental flow-control method for a flow-control filter string in the oil-gas well and a structure of the oil-gas well, wherein a sand control screen is already disposed in the oil-gas well. The oil-gas well here refers to a production well in a broad sense in oil-gas development, including an oil well, a gas well, an injection well or the like.

BACKGROUND ART

During production of the oil-gas well, no matter whether the well is a vertical well or a horizontal well, due to factors such as heterogeneity of oil reservoir, the well needs to be packed off into a plurality of relatively independent zones for production, and flow is controlled in segments for production. The oil-gas well production here comprises output and injection of a fluid during production of the oil-gas well, such as petroleum exploitation, or injection of water, gas, a chemical agent for improving a recovery rate of the oil field or the like, into the formation during production, or injection of an acid liquid into the formation during some operations.

The oil-gas well is packed off into a plurality of relatively independent zones for production usually by a method of using a flow-control device in combination with a device of separating the production segment of the oil-gas well into several flow units in an axial direction of the oil-gas well, for example, by a method of using a flow-control filter string plus a packer.

For the sake of prevention of sand, a sand control screen is provided for many wells in the oil-gas field. FIG. 1 shows a structure of an oil-gas well into which a sand control screen is already run, comprising a well wall 1, a sand control screen 2, a clearance 3 between the sand control screen and the well wall, and a packer 4 for hanging the sand control screen. Those skilled in the art can all appreciate that the clearance 3 between the sand control screen and the well wall comprises but is not limited to an entire annular clearance between the sand control screen and the well wall or a partial annular clearance which is partially collapsed between the sand control screen and the well wall or other similar interval space.

In many oil-gas wells, production of segmental flow control is implemented by running the flow-control filter string and the packer in the well, and actively packing off the clearance between the flow-control filter string and the well wall by adding the packer to the flow-control filter string, i.e., obstructing an axial channeling flow passage outside the flow-control filter string to achieve better production of segmental flow control.

However, the manner of the flow-control filter string plus the packer has serious problems in the oil-gas well into which the sand control screen is already run. As shown in FIG. 2, in the oil-gas well into which the sand control screen is already run, there is an unpacked-off clearance between the sand control screen and the well wall. Since this kind of clearance can form an axial channeling flow passage, it damages the pack-off effect between the flow-control filter string in the sand control screen and the sand control screen, and therefore leads to failure to achieve very good production of segmental flow control. FIG. 2 further discloses a flow-control filter string 5, a flow-control filter 6 on the flow-control filter string, a packer 10 disposed in an annular space between the flow-control filter string and the sand control screen, and a hold-down packer 8 for hanging the flow-control filter string. The arrow in the figure indicates the flow direction of a channeling fluid such as water. As shown in FIG. 2, the channeling fluid such as water enters the clearance between the well wall and the sand control screen through the well wall, forms an axial channeling flow in the clearance between the well wall and the sand control screen, and then enters the flow-control filter string, thereby ruining the pack-off effect between the flow-control filter string in the sand control screen and the sand control screen, and failing to achieve an excellent production of segmental flow control.

As can be seen from the above, in order to achieve production of segmental flow control by using the flow-control filter string plus the packer in the oil-gas well into which the sand control screen is already run, there is a need to draw out the sand control screen already run into the oil-gas well, and then run the flow-control filter string and the packer. However, in many cases, since the sand control screen is very long, the resistance between the sand control screen and the well wall is very large, which resistance is caused largely because sand jam occurs partially on the sand control screen. Especially for a horizontal well, in a majority of situations, the sand control screen cannot be pulled out, and further, because its production segment is very long, the horizontal well particularly need to employ production of segmental flow control, so as to solve the problem of quick rise of water content in the produced liquid of the horizontal well, for example. Hence, this problem is relatively prominent, especially for horizontal wells.

SUMMARY OF THE INVENTION

An object of the present invention is to overcome the defect that the effect of segmental flow control in the combination solution of a flow-control filter string and packers is poor, which is caused by a clearance existing between a sand control screen and a well wall in an oil-gas well into which the sand control screen is already run, and to provide a segmental flow-control method for the flow-control filter string adapted for the oil-gas well having the sand control screen to achieve better pack-off and thereby achieve an excellent effect of segmental flow control of the flow-control filter string.

Specifically, in one aspect, the present invention provides a segmental flow-control method for a flow-control filter string in an oil-gas well, wherein the oil-gas well comprises a well wall and a sand control screen already run within the well wall, and a clearance at least partially exists between the sand control screen and the well wall; the segmental flow-control method for the flow-control filter string comprises the following steps:

running the flow-control filter string: running the flow-control filter string into the sand control screen, wherein the flow-control filter string is provided with flow-control filters, and an annular space is at least partially formed between the flow-control filter string and the sand control screen;

filling with anti-channeling flow pack-off particles: injecting the particle-carrying liquid carrying the anti-channeling flow pack-off particles into the annular space through a particle-carrying liquid injection passage, wherein the particle-carrying liquid carries the anti-channeling flow pack-off particles into the annular space and the clearance;

sealing: sealing the particle-carrying liquid injection passage or closing a communicating portion between the particle-carrying liquid injection passage and the annular space.

Preferably, anti-channeling flow pack-off particles entering the annular space and clearance accumulate in, fill and fully stuff the annular space and the clearance.

Preferably, the particle-carrying liquid injection passage is an annular space between an upper portion of the flow-control filter string and the sand control screen.

Preferably, a packer is provided on top of the upper portion of the flow-control filter string for hanging the flow-control filter string, the particle-carrying liquid injection passage is a passage which is in the packer or around the packer and not closed during injection of the particle-carrying liquid so as to allow the particle-carrying liquid to flow therethrough.

Preferably, under the circumstances that the flow-control filter string is run into the sand control screen by a run-in string, the segmental flow-control method for the flow-control filter string further comprises: after the sealing step, disconnecting the run-in string connected to the flow-control filter string so as to form a completion well structure wherein the anti-channeling flow pack-off particles fill the annular space and the clearance.

Preferably, the segmental flow-control method for the flow-control filter string further comprises the following step: establishing a flowing channel before the step of running the flow-control filter string, i.e., forming on the sand control screen at least one flowing channel allowing the particle-carrying liquid carrying the anti-channeling flow pack-off particles to enter the clearance from the annular space or directly through the particle-carrying liquid injection passage.

Preferably, the step of establishing the flowing channel comprises drilling on the sand control screen at least one flowing channel in the form of a through hole by a sidetrack drilling method to help the particle-carrying liquid carrying the anti-channeling flow pack-off particles to enter the clearance from the annular space.

Preferably, the step of establishing the flowing channel comprises perforating on the sand control screen at least one flowing channel in the form of a through hole by a perforating method to help the particle-carrying liquid carrying the anti-channeling flow pack-off particles to enter the clearance from the annular space.

Preferably, the step of establishing the flowing channel comprises unsetting the packer for hanging the sand control screen to form at the packer a channel facilitating the particle-carrying liquid carrying the anti-channeling flow pack-off particles to enter the clearance directly through the particle-carrying liquid injection passage, and closing the packer after the anti-channeling flow pack-off particles fully stuff the annular space and the clearance.

In another aspect, the present invention provides an oil-gas well structure, comprising: a well wall; and a sand control screen already run within the well wall, a clearance at least partially formed between the sand control screen and the well wall; wherein the flow-control filter string is run into the sand control screen, the flow-control filter string is provided with flow-control filters, and an annular space is formed between the flow-control filter string and the sand control screen; the annular space and the clearance are filled with the anti-channeling flow pack-off particles.

Preferably, the anti-channeling flow pack-off particles fully stuff the annular space and the clearance.

Preferably, the sand control screen is formed with at least one flowing channel in the form of a through hole allowing the particle-carrying liquid carrying the anti-channeling flow pack-off particles to pass therethrough.

The oil-gas well structure according to the present invention is preferably implemented by the segmental flow-control method for the flow-control filter string according to the present invention.

In a yet another aspect, the present invention further provides a segmental flow-control method for a flow-control filter string in an oil-gas well having a sand control screen, wherein the oil-gas well having the sand control screen comprises a well wall and a sand control screen already run within the well wall, one end of the sand control screen adjacent to a well mouth is fixedly connected to the well wall, an annular clearance is formed between the sand control screen and the well wall; the segmental flow-control method for the flow-control filter string comprises the following steps:

1) establishing a channel: forming on the sand control screen at least one flowing channel allowing the particle-carrying liquid carrying the anti-channeling flow pack-off particles to pass therethrough;

2) running the flow-control filter string: running one flow-control filter string into the sand control screen by a run-in string, wherein the flow-control filter string is provided with at least two flow-control filters, and an annular space is formed between the flow-control filter string and the sand control screen;

3) filling with anti-channeling flow pack-off particles: injecting the particle-carrying liquid carrying the anti-channeling flow pack-off particles into the annular space between the flow-control filter string and the sand control screen; the particle-carrying liquid carries the anti-channeling flow pack-off particles simultaneously into the annular space between the flow-control filter string and the sand control screen and the annular clearance between the sand control screen and the well wall, and the anti-channeling flow pack-off particles simultaneously accumulate in, fill and fully stuff the annular space between the flow-control filter string and the sand control screen and the annular clearance between the sand control screen and the well wall;

4) sealing: sealing at the end adjacent to the well mouth the annular space which is between the flow-control filter string and the sand control screen and fully stuffed with the anti-channeling flow pack-off particles;

5) disconnecting the run-in string connected to the flow-control filter string, thereby forming a completion well structure wherein both the annular space between the flow-control filter string and the sand control screen and the annular clearance between the sand control screen and the well wall are fully stuffed with the anti-channeling flow pack-off particles.

Preferably, the step of establishing the channel comprises drilling on the sand control screen at least one through hole by a sidetrack drilling method to help the particle-carrying liquid carrying the anti-channeling flow pack-off particles to pass therethrough.

Preferably, the step of establishing the channel comprises perforating at least one through hole in the sand control screen by a perforating method to help the particle-carrying liquid carrying the anti-channeling flow pack-off particles to pass therethrough.

Preferably, the step of establishing the channel comprises unsetting the packer for hanging the sand control screen to form at the packer hanging the sand control screen a channel facilitating the particle-carrying liquid carrying the anti-channeling flow pack-off particles to pass therethrough; after the anti-channeling flow pack-off particles fully stuff the annular space between the flow-control filter string and the sand control screen and the annular clearance between the sand control screen and the well wall, and the packer hanging the sand control screen is closed.

In embodiments according to the respective aspects of the present invention, preferably, the sand control screen is a slotted screen, a sand control screen using a metal woven mesh as a filtering material, a punched slot screen, a wire wrapped screen, a metal powder or resin-sand grain sand control screen, a porous ceramic sand control screen, a metal cotton fiber sand control screen or a dual-layer pre-packed sand control screen.

In embodiments according to the respective aspects of the present invention, preferably, the anti-channeling flow pack-off particles are carried by the particle-carrying liquid into the annular space and the clearance, a true particle density of the anti-channeling flow pack-off particles is close to a density of the particle-carrying liquid so that the anti-channeling flow pack-off particles are adapted to be carried by the particle-carrying liquid into the clearance.

In embodiments according to the respective aspects of the present invention, preferably, the true particle density of the anti-channeling flow pack-off particles is any value in a range of 0.4 g/cm$^3$ greater than or less than a density of the particle-carrying liquid.

In embodiments according to the respective aspects of the present invention, preferably, the true particle density of the anti-channeling flow pack-off particles is any value in a range of 0.2 g/cm$^3$ greater than or less than the density of the particle-carrying liquid.

In embodiments according to the respective aspects of the present invention, preferably, the particle-carrying liquid carrying the anti-channeling flow pack-off particles is water or aqueous solution.

In embodiments according to the respective aspects of the present invention, preferably, the anti-channeling flow pack-off particles comprise macromolecular polymer particles having an average particle size of 0.05-1.0 mm and a true particle density of 0.8-1.4 g/cm$^3$.

In embodiments according to the respective aspects of the present invention, preferably, the anti-channeling flow pack-off particles comprise macromolecular polymer particles having an average particle size of 0.1-0.5 mm and a true particle density of 0.94-1.06 g/cm$^3$.

In embodiments according to the respective aspects of the present invention, preferably, the anti-channeling flow pack-off particles comprise high-density polyethylene particles having an average particle size of 0.1-0.5 mm and a true particle density of 0.90-0.98 g/cm$^3$.

In embodiments according to the respective aspects of the present invention, preferably, the anti-channeling flow pack-off particles comprise styrene divinylbenzene crosslink copolymer particles having an average particle size of 0.05-1.0 mm and a true particle density of 0.96-1.06 g/cm$^3$.

In embodiments according to the respective aspects of the present invention, preferably, the anti-channeling flow pack-off particles comprise polypropylene and polyvinyl chloride macromolecular polymer particles having an average particle size of 0.05-1.0 mm and a true particle density of 0.8-1.2 g/cm$^3$.

Here, it should be particularly noted that the term "true particle density" used in the present invention is an actual density of a single particle itself rather than a particle packing density as measured from a lot of accumulated particles, which can be clearly understood by those skilled in the art.

The present invention preferably uses water or an aqueous solution with a density of 1.0 g/cm$^3$ as the particle-carrying liquid carrying the anti-channeling flow pack-off particles. In the present invention, the anti-channeling flow pack-off particles having the true particle density close to the density of the particle-carrying liquid are particularly selected so that the particle-carrying liquid can very easily carry the anti-channeling flow pack-off particles to fill the annular space between the flow-control filter string and the sand control screen and the clearance between the sand control screen and the well wall, and the anti-channeling flow pack-off particles accumulate in, fill, and fully stuff the annular space between the flow-control filter string and the sand control screen and the clearance between the sand control screen and the well wall. Thereafter, a portion of particle-carrying liquid enters the flow-control filters and returns to the ground, and another portion of the particle-carrying liquid permeates into the formation through the well wall. Finally, there is formed a completion well structure in which the annular space between the flow-control filter string and the sand control screen and the clearance between the sand control screen and the well wall are fully stuffed with the anti-channeling flow pack-off particles. The anti-channeling flow pack-off particles fill compactly so that there is substantially no channeling path. The oil-gas well can be effectively packed off into a plurality of relatively independent zones for production of the oil-gas well in combination with the flow-control filter string, thereby achieving the purpose of flow control, facilitating segmental management of flow, and bringing good effects to production of the oil-gas well, such as improving the oil output and the recovery rate of the oil-gas well.

Moreover, even if the anti-channeling flow pack-off particles are filled not compactly enough and channeling path remain in clearances, during production axial channeling flow of a very small amount of liquid will bring the anti-channeling flow pack-off particles to move to accumulate towards and obstruct the channeling path, thereby achieving an excellent anti-channeling flow pack-off effect and achieving the segmental flow control of flow-control filter string in an oil-gas well in combination with a flow-control filter string.

Flowing of the formation fluid in the medium formed by accumulation of anti-channeling flow pack-off particles is a seepage flow. According to principles of fluid mechanics in porous medium, a magnitude of a seepage resistance is directly proportional to a seepage distance and inversely proportional to a seepage area. Since the anti-channeling flow pack-off particles in the annular space between the flow-control filter string and the sand control screen and the clearance between the sand control screen and the well wall are accumulated with a small thickness, a small section and a large axial length, the channeling flow of the formation fluid in the anti-channeling channeling flow pack-off particles in the axial direction of the oil-gas well meets a very large flow resistance whereas the flow in a radial direction of the oil-gas well meets a very small flow resistance because the flow area is large and flow distance is short. The flow resistance upon flow in the axial direction of the oil-gas well several meters to scores of meters is hundreds of even thousands of times greater than the flow resistance upon flow in the radial direction of the oil-gas well several centimeters. The substantial difference between the flow resistance in the axial direction and the flow resistance in the radial direction of the oil-gas well causes the flow in the axial direction of the oil-gas well to be by far smaller than the flow in the radial direction of the oil-gas well under the same pressure differential. Such discrepancy of flow resistance of the anti-channeling flow pack-off particles in the axial direction and radial direction can ensure smooth flow of the formation fluid in the radial direction of the oil-gas well and meanwhile limit the flow of the formation fluid in the axial direction of the oil-gas well, thereby functioning as a packer.

The present invention provides a convenient and practical segmental flow-control method for the flow-control filter string in an oil-gas well having a sand control screen. The method can achieve pack-off of the annular space between the flow-control filter string and the sand control screen and the clearance between the sand control screen and the well wall, achieve a good pack-off effect and very well achieve segmental flow control by the flow-control filter string in combination with the flow-control filter string.

DETAILED DESCRIPTION OF THE PREFERRED EMBODIMENTS

Figure 1:
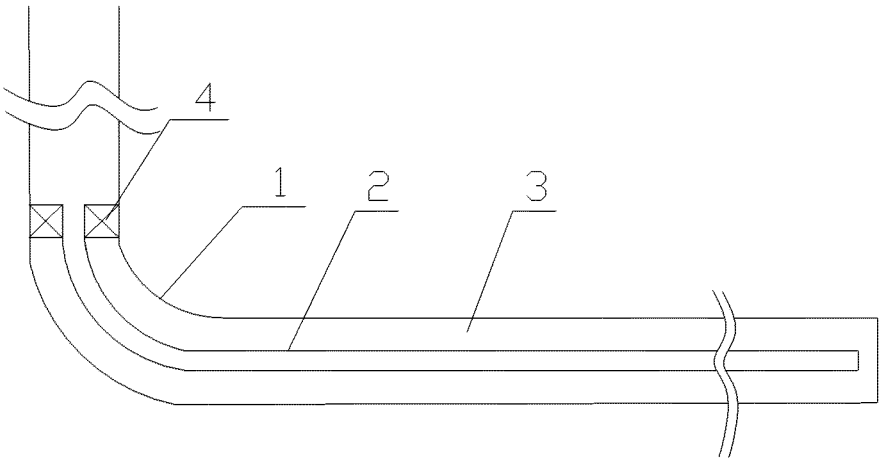
Figure 1 (Prior Art)
FIG. 1 is a structurally schematic view of an oil-gas well in the prior art in which a sand control screen is already run.
Figure 2:
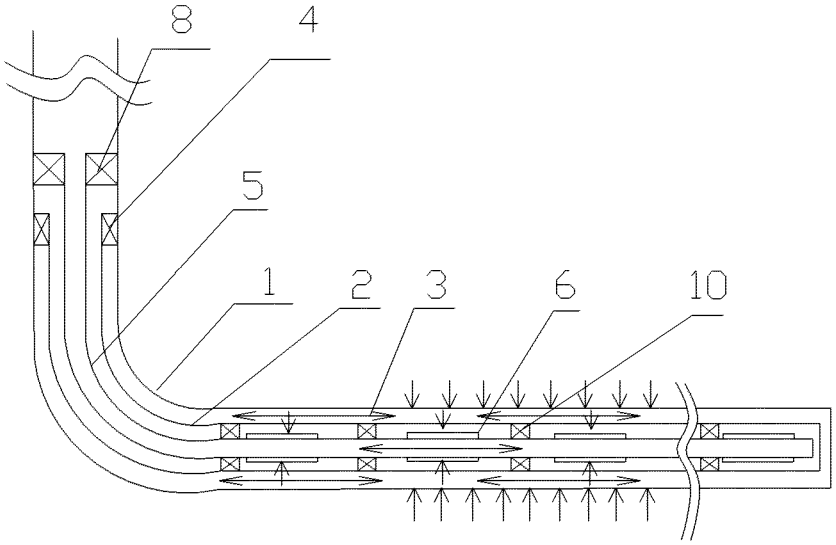
FIG. 2 illustrates a structurally schematic view when a flow-control filter string is run into the sand control screen, an annular space between the flow-control filter string and the sand control screen is packed off by a packer, but a clearance between the sand control screen and the well wall is not yet packed off.
Figure 3:
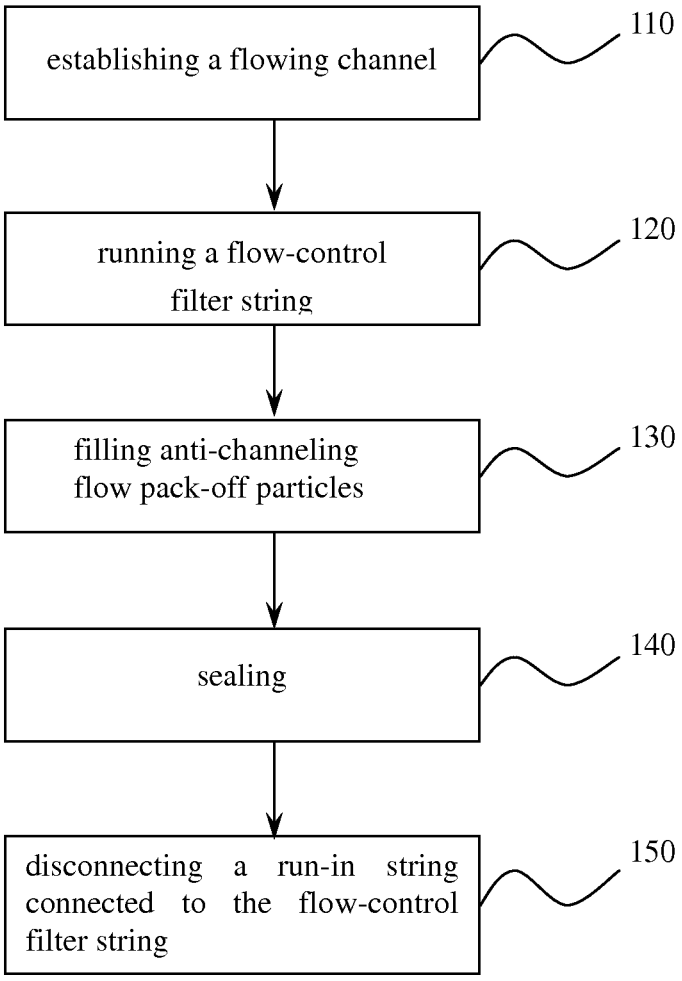
FIG. 3 shows an illustrative flowchart of a segmental flow-control method for the flow-control filter string adapted for an oil-gas well having a sand control screen according to the present invention.

Referring to FIG. 3, the figure generally shows an illustrative flowchart of a segmental flow-control method for a flow-control filter string adapted for an oil-gas well having a sand control screen according to the present invention. The oil-gas well for which the method is adapted is as shown in FIG. 1, and comprises a well wall 1 and a sand control screen 2 already set in the oil-gas well. Furthermore, a packer 4 for hanging the sand control screen is preferably provided between the sand control screen 2 and the well wall 1, and a clearance 3 (which is an annular clearance in this example) is formed between the sand control screen 2 and the well wall 1. The segmental flow-control method for the flow-control filter string according to the present invention generally comprises the following steps:

Step 110: establishing a flowing channel: forming on the sand control screen 2 at least one flowing channel 2-1 allowing a particle-carrying liquid carrying an anti-channeling flow pack-off particles to enter the clearance 3 between the sand control screen and the well wall from an annular space between the flow-control filter string and the sand control screen or directly through a particle-carrying liquid injection passage. Particularly, as specifically described in the following embodiments, the flowing channel can comprise at least one flowing channel in the form of a through hole drilled on the sand control screen by a sidetrack drilling method or perforated on the sand control screen by a perforation method to help the particle-carrying liquid carrying the anti-channeling flow pack-off particles to enter the clearance from the annular space. Alternatively, the flowing channel is formed by unsetting the packer for hanging the sand control screen, which will be described in detail hereunder. In addition, the flowing channel can be formed by other suitable methods, for example, it is an optional alternative method to expand and crack the sand control screen. Those skilled in the art should also appreciate that if cut slots or punched slots already available on the sand control screen can allow the particle-carrying liquid carrying the anti-channeling flow pack-off particles to pass, the step of establishing the flowing channel can be omitted.

Step 120: running the flow-control filter string: running the flow-control filter string 5 by preferably a run-in string into the sand control screen 2 (the run-in string per se is well known by those skilled in the art and not shown in the drawings). The flow-control filter string is provided with at least two flow-control filters 6, and an annular space is at least partially formed between the flow-control filter string 5 and the sand control screen 2.

Step 130: filling with the anti-channeling flow pack-off particles: injecting the particle-carrying liquid carrying the anti-channeling flow pack-off particles into the annular space between the flow-control filter string and the sand control screen through the particle-carrying liquid injection passage. For example, the particle-carrying liquid injection passage can be an annular space between an upper portion of the flow-control filter string 5 and a corresponding portion of the sand control screen 2. Alternatively, under the circumstance that a packer 8 is provided on top of the flow-control filter string 5 for hanging the flow-control filter string, the particle-carrying liquid injection passage for example can be a passage which is in the packer 8 or around it and not closed during injection of the particle-carrying liquid so as to allow the particle-carrying liquid to flow therethrough. Those skilled in the art all appreciate that the particle-carrying liquid injection passage can further be any other passages or injection ports which are adapted to inject the particle-carrying liquid into the annular space between the filter string and the sand control screen. The particle-carrying liquid carries the anti-channeling flow pack-off particles into the annular space between the flow-control filter string and the sand control screen and the clearance between the sand control screen and the well wall, and the anti-channeling flow pack-off particles accumulate in, fill and fully stuff the annular space between the flow-control filter string and the sand control screen and the clearance between the sand control screen and the well wall.

Step 140: sealing: sealing the particle-carrying liquid injection passage or closing a communicating portion between the particle-carrying liquid injection passage and the annular space. For example, by setting the packer 8 hanging the flow-control filter string, the annular space between the upper portion of the flow-control filter string and the sand control screen can be completely sealed (that is, the passage which is between a vicinity of the packer 8 and the sand control screen and allows the particle-carrying liquid to pass therethrough). Again for example, if the injection passage operably allowing the particle-carrying liquid to pass therethrough is configured in the packer 8, the packer 8 is disposed and set after the flow-control filter string 5 is run, and the particle-carrying liquid can enter the annular space between the filter string and the sand control screen and the clearance between the sand control screen and the well wall through the injection passage in the packer 8; upon completion of injection, the injection passage in the packer 8 is closed by actuating a movable part in the packer 8 or using an additional mechanism.

Step 150: disconnecting a run-in string: under the circumstances that the flow-control filter string 5 is run by a run-in string, the run-in string connected to the flow-control filter string should be disconnected at this time so as to form a completion well structure wherein the annular space between the flow-control filter string and the sand control screen and the clearance between the sand control screen and the well wall are fully stuffed with the anti-channeling flow pack-off particles. Those skilled in the art can appreciate that when other running-in methods or devices currently known or to be known in the future are employed, step 150 may not be requisite.

Figure 7:
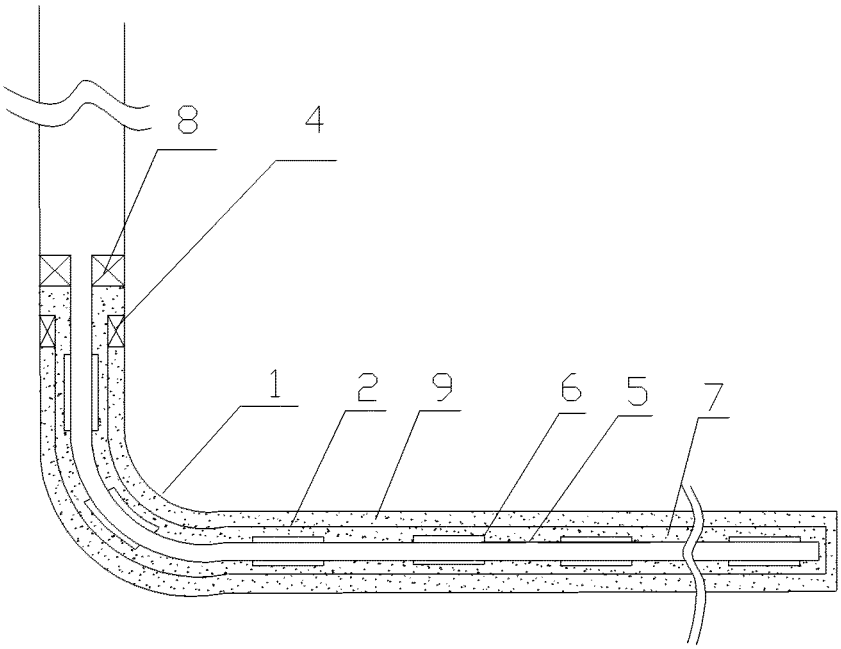
FIG. 7 is a structurally schematic view of a completion well structure wherein the annular space between the flow-control filter string and the sand control screen and the clearance between the sand control screen and the well wall are fully stuffed with the anti-channeling flow pack-off particles according to a preferred embodiment of the present invention.

For example, the completion well structure formed by the method according to the present invention is shown in FIG. 7 and preferably can comprise an oil-gas well wall 1, a sand control screen 2, a packer 4 for hanging the sand control screen, a flow-control filter string 5, a flow-control filter 6 on the flow-control filter string, anti-channeling flow pack-off particles 7 filled in the annular space between the flow-control filter string and the sand control screen, a hold-down packer 8 for hanging the flow-control filter string, and anti-channeling flow pack-off particles 9 filled in the clearance between the sand control screen and the well wall.

Application of the method according to the present invention will be described in detail with reference to several preferred embodiments according to principles of the present invention.

Embodiment 1

Figure 4:
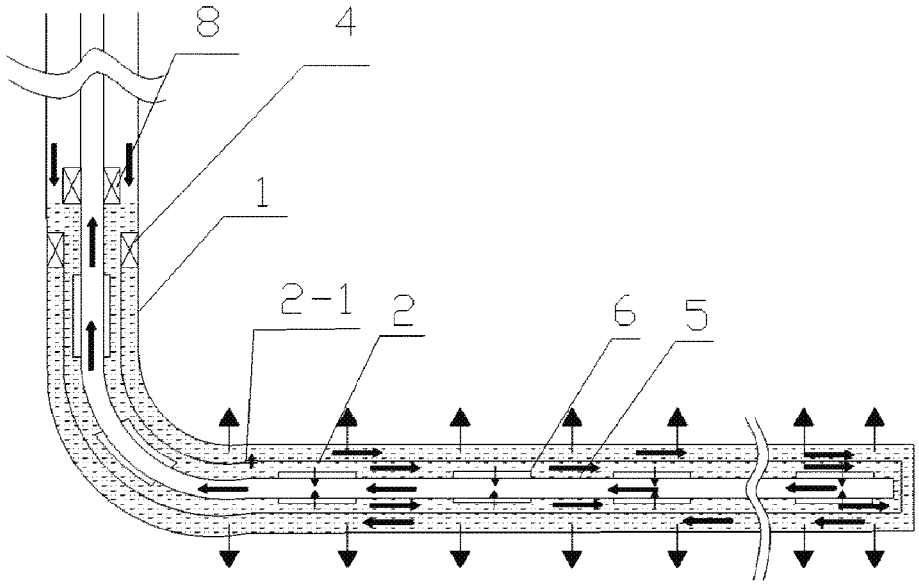
FIG. 4 is a schematic view showing downhole conditions and flow of the particle-carrying liquid upon the filling of the anti-channeling flow pack-off particles according to the segmental flow-control and well-completing method of the flow-control filter string in an oil-gas well having a sand control screen which is drilled a flowing channel in the form of a through hole by a sidetrack drilling method according to a first embodiment of the present invention.

Referring to FIG. 4, the sand control screen 2 in the embodiment is preferably a slotted screen. The segmental flow-control method for the flow-control filter string according to the present invention is specifically implemented as comprising the following steps:

1) sidetrack drilling on the sand control screen 2 at least one flowing channel 2-1 in the form of a through hole to help the particle-carrying liquid carrying the anti-channeling flow pack-off particles to pass therethrough; the particle-carrying liquid is water or an aqueous solution in which a certain reservoir protection agent is solved; a density of the aqueous solution is close to water, approximately 1.0 g/cm$^3$.

The particles are preferably high-density polyethylene particles with a particle size of 0.1-0.5 mm and a true particle density of 0.96 g/cm$^3$.

2) running the flow-control filter string 5 in by a run-in string into the sand control screen 2, wherein the flow-control filter string is provided with flow-control filters 6, the hold-down packer 8 for hanging the flow-control filter string is provided between the flow-control filter string and the well wall, and an annular space is formed between the flow-control filter string and the sand control screen.

3) injecting the particle-carrying liquid carrying the anti-channeling flow pack-off particles into the annular space between the flow-control filter string 5 and the sand control screen 2 through the particle-carrying liquid injection passages (the passages shown by the arrows on the left and right sides of the hold-down packer 8 in FIG. 4); The particle-carrying liquid carries the anti-channeling flow pack-off particles into the annular space between the flow-control filter string and the sand control screen and the clearance between the sand control screen and the well wall, and the anti-channeling flow pack-off particles accumulate in, fill and fully stuff the annular space between the flow-control filter string and the sand control screen and the clearance between the sand control screen and the well wall. A portion of particle-carrying liquid enters the flow-control filter and returns to the ground, and another portion of the particle-carrying liquid permeates into the formation through the well wall; the arrows in FIG. 4 show a flow direction of the particle-carrying liquid.

4) closing the hold-down packer 8 for hanging the flow-control filter string and conducting sealing between the flow-control filter string and the well wall;

5) disconnecting the run-in string connected to the flow-control filter string so as to form a completion well structure as shown in FIG. 7 wherein the annular space between the flow-control filter string and the sand control screen and the clearance between the sand control screen and the well wall are fully stuffed with the anti-channeling flow pack-off particles.

Embodiment 2

Figure 5:
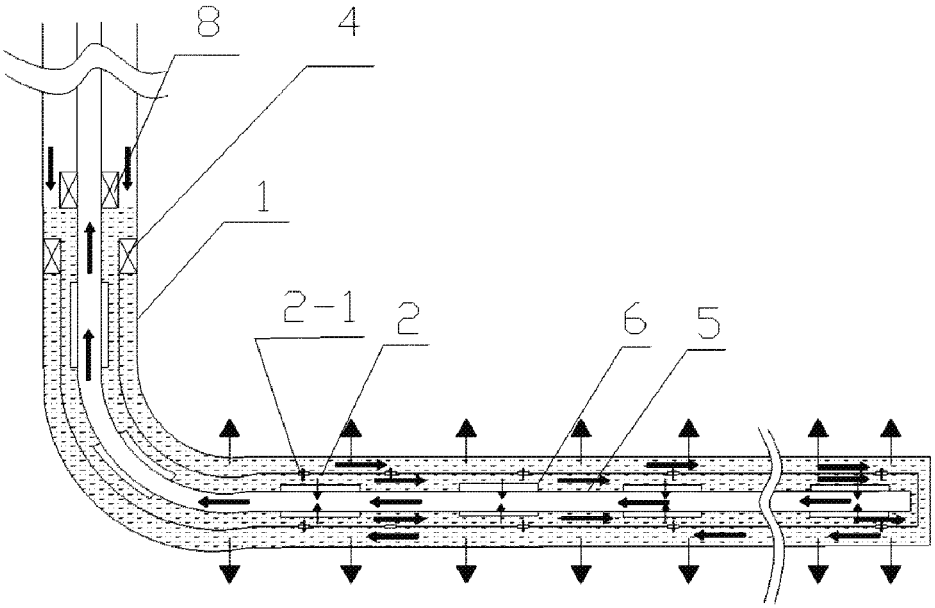
FIG. 5 is a schematic view showing downhole conditions and flow of the particle-carrying liquid upon the filling of the anti-channeling flow pack-off particles according to the segmental flow-control and well-completing method of the flow-control filter string in an oil-gas well having a sand control screen which is perforated a flowing channel in the form of a through hole by a perforating method according to a second embodiment of the present invention.

Referring to FIG. 5, the sand control screen 2 in the embodiment is preferably a sand control screen using a metal woven mesh as a filtering material. The segmental flow-control method for the flow-control filter string according to the present invention is specifically implemented as comprising the following steps:

1) as shown in FIG. 5, perforating the sand control screen to form a plurality of flowing channels 2-1 in the form of through holes by a perforating method to help the particle-carrying liquid carrying the anti-channeling flow pack-off particles to pass therethrough; the particle-carrying liquid is preferably water or an aqueous solution in which a certain reservoir protection agent is solved; a density of the aqueous solution is close to water, approximately 1.0 g/cm$^3$. The anti-channeling flow pack-off particles are styrene divinylbenzene crosslink copolymer particles with an average particle size of 0.1-0.5 mm and a true density of 0.96-1.06 g/cm$^3$.

2) as shown in FIG. 5, running the flow-control filter string 5 by a run-in string into the sand control screen, wherein the flow-control filter string is provided with flow-control filters 6, the hold-down packer 8 for hanging the flow-control filter string is provided between the upper portion of the flow-control filter string and the well wall, and an annular space is formed between the flow-control filter string and the sand control screen.

3) as shown in FIG. 5, injecting the particle-carrying liquid carrying the anti-channeling flow pack-off particles into the annular space between the flow-control filter string and the sand control screen through the particle-carrying liquid injection passages (the passages shown by the arrows on the left and right sides of the hold-down packer 8 in FIG. 5); The particle-carrying liquid carries the anti-channeling flow pack-off particles into the annular space between the flow-control filter string and the sand control screen and the clearance between the sand control screen and the well wall, and the anti-channeling flow pack-off particles accumulate in, fill and fully stuff the annular space between the flow-control filter string and the sand control screen and the clearance between the sand control screen and the well wall. A portion of particle-carrying liquid enters the flow-control filter and returns to the ground, and another portion of the particle-carrying liquid permeates into the formation through the well wall; the arrows in FIG. 5 show a flow direction of the particle-carrying liquid.

4) closing the hold-down packer 8 for hanging the flow-control filter string and conducting sealing between the flow-control filter string and the well wall;

5) disconnecting the run-in string connected to the flow-control filter string so as to form a completion well structure as shown in FIG. 7 wherein the annular space between the flow-control filter string and the sand control screen and the clearance between the sand control screen and the well wall are fully stuffed with the anti-channeling flow pack-off particles.

Embodiment 3

Figure 6:
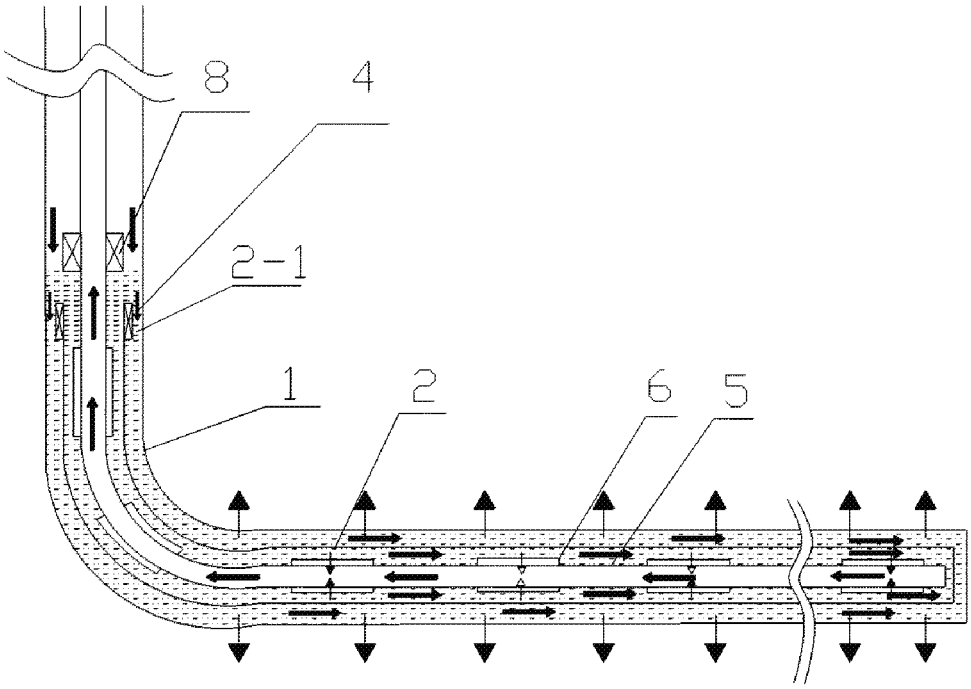
FIG. 6 is a schematic view showing downhole conditions and flow of the particle-carrying liquid upon the filling of the anti-channeling flow pack-off particles according to the segmental flow-control and well-completing method of the flow-control filter string in an oil-gas well having a sand control screen on which upper portion is manufactured a flowing channel in the form of a through hole by unsetting the packer hanging the sand control screen according to a third embodiment of the present invention.

Referring to FIG. 6, the sand control screen 2 in the embodiment is preferably a punched slot screen. The segmental flow-control method for the flow-control filter string according to the present invention is specifically implemented as comprising the following steps:

1) as shown in FIG. 6, unsetting the packer 4 for hanging the sand control screen 2 to form at the packer for hanging the sand control screen a channel 2-1 facilitating the passing of the particle-carrying liquid carrying the anti-channeling flow pack-off particles; as for a packer which can be unset by lifting, the unsetting method thereof is lifting up the packer so that the packer can automatically unset. As far as a packer which can be rotatably unset is concerned, the packer is rotated to automatically unset. After the unsetting, there is a clearance between the packer and the well wall and the clearance becomes the flowing channel of the particle-carrying liquid. The anti-channeling flow pack-off particles are polypropylene and polyvinyl chloride macromolecular polymer particles with an average particle size of 0.05-1.0 mm (such as 0.3-0.5 mm) and a true particle density of 0.8-1.2 g/cm$^3$.

2) as shown in FIG. 6, running the flow-control filter string 5 by a run-in string into the sand control screen, wherein the flow-control filter string is provided with flow-control filters 6, the hold-down packer 8 for hanging the flow-control filter string is provided between the flow-control filter string and the well wall, and an annular space is formed between the flow-control filter string 5 and the sand control screen 2.

3) as shown in FIG. 6, injecting the particle-carrying liquid carrying the anti-channeling flow pack-off particles into the annular space between the flow-control filter string and the sand control screen through the particle-carrying liquid injection passages (the passages shown by the arrows on the left and right sides of the hold-down packer 8 in FIG. 6); The particle-carrying liquid carries the anti-channeling flow pack-off particles into the annular space between the flow-control filter string and the sand control screen and the clearance between the sand control screen and the well wall, and the anti-channeling flow pack-off particles accumulate in, fill and fully stuff the annular space between the flow-control filter string and the sand control screen and the clearance between the sand control screen and the well wall. A portion of particle-carrying liquid enters the flow-control filter and returns to the ground, and another portion of the particle-carrying liquid permeates into the formation through the well wall; the arrows in FIG. 6 show a flow direction of the particle-carrying liquid.

4) closing the hold-down packer 8 hanging the flow-control filter string and the packer 4 hanging the sand control screen; if the hold-down packer hanging the flow-control filter string is higher than the packer hanging the sand control screen, the anti-channeling flow pack-off particles in the clearance and annular space outside and inside the sand control screen may be sealed by closing the hold-down packer 8 hanging the flow-control filter string.

5) disconnecting the run-in string connected to the flow-control filter string so as to form a completion well structure as shown in FIG. 7 wherein the annular space between the flow-control filter string and the sand control screen and the clearance between the sand control screen and the well wall are fully stuffed with the anti-channeling flow pack-off particles.

In the above embodiments, water or aqueous solution is preferably used as the particle-carrying liquid carrying the anti-channeling flow pack-off particles, and the density of the particle-carrying liquid is close to 1.0 g/cm$^3$. Hence, in the present invention macromolecular polymer particles having a true particle density very close to the density of water are selected as the anti-channeling flow pack-off particles. The true particle density of the anti-channeling flow pack-off particles is almost equal to the density of the particle-carrying liquid. As such, the particle-carrying liquid can very easily carry the anti-channeling flow pack-off particles into the annular space between the flow-control filter string and the sand control screen and the clearance between the sand control screen and the well wall, and the anti-channeling flow pack-off particles accumulate in, fill and fully stuff the annular space between the flow-control filter string and the sand control screen and the clearance between the sand control screen and the well wall. A portion of particle-carrying liquid enters the flow-control filter and returns to the ground, and another portion of the particle-carrying liquid permeates into the formation through the well wall; finally there is formed a completion well structure wherein the annular space between the flow-control filter string and the sand control screen and the clearance between the sand control screen and the well wall are fully stuffed with the anti-channeling flow pack-off particles.

Flowing of a fluid in the accumulation of anti-channeling flow pack-off particles is a seepage flow. According to principles of fluid mechanics in porous medium, a magnitude of a seepage resistance is directly proportional to a seepage distance and inversely proportional to a seepage area. Since the anti-channeling flow pack-off particles are constructed with a small thickness, a small section and a large axial length, the channeling flow of the formation fluid in the anti-channeling flow pack-off particles in the axial direction of the oil-gas well meets a very large flow resistance whereas the flow in a radial direction of the oil-gas well meets a very small flow resistance because the flow area is large and flow distance is short. The flow resistance upon flow in the axial direction of the oil-gas well several meters or scores of meters is hundreds of even thousands of times greater than the flow resistance upon flow in the radial direction of the oil-gas well several centimeters. The substantial difference between the flow resistance in the axial direction and the flow resistance in the radial direction of the oil-gas well causes the flow in the axial direction of the oil-gas well to be by far smaller than the flow in the radial direction of the oil-gas well under the same pressure differential. Such discrepancy of flow resistance of the anti-channeling flow pack-off particles in the axial direction and radial direction can ensure smooth flow of the formation fluid in the radial direction of the oil-gas well and meanwhile limit the flow of the formation fluid in the axial direction of the oil-gas well, thereby functioning as a packer.

The present invention provides a convenient and practical segmental flow-control method by flow-control filters in an oil-gas well having a sand control screen. The method can achieve pack-off of the annular space between the flow-control filter string and the sand control screen and the clearance between the sand control screen and the well wall, achieve a good pack-off effect and very well achieve segmental flow control of the flow-control filter string in the well already having the sand control screen.

The production segment stated in the present invention is a production segment in a broad sense. A length range of the production segment may cover segments in which a fluid cannot flow, such as an interlayer, a sandwich layer, or imperforated segments after casing cementing.

The flow-control filter string in the present invention includes a filtration segment and blank segments which are arranged in an alternate way. The blank segments are pipe segments which wall surface is not perforated. The anti-channeling flow pack-off particles outside the blank segments play a major role of preventing channeling flow in the axial direction. Blank segments are provided from two aspects: one aspect is that each filter in fact comprises a filtration segment and blank segments, wherein the blank segments are located at both ends of the filter and are provided with threads, and when the filter is connected by screwing the thread, the blank segments are to be gripped by pliers; the other aspect is that a blank segment is added between two filters. The anti-channeling flow pack-off particles are preferably circular.

Finally, it should be appreciated that obviously the above embodiments are only examples to make the present invention apparent and are not intended to limit implementation modes. Those skilled in the art apprehend that other variations or modifications in different forms can also made on the basis of the above description, for example, the position and configuration of the particle-carrying liquid injection passage can have various variations. It is unnecessary and incapable herein to list all the implementation modes. Obvious variations and modifications made on the basis of the description still fall within the protection scope of the present invention.

What is claimed is:

1. A segmental flow-control method for a flow-control filter string in an oil-gas well, wherein the oil-gas well comprises a well wall and a sand control screen already run within the well wall, and a clearance exists between the sand control screen and the well wall;

the segmental flow-control method for the flow-control filter string comprises the following steps:

running the flow-control filter string: running the flow-control filter string into the sand control screen, wherein the flow-control filter string is provided with flow-control filters, and an annular space is formed between the flow-control filter string and the sand control screen;

filling with anti-channeling flow pack-off particles: injecting a particle-carrying liquid carrying the anti-channeling flow pack-off particles into the annular space through a particle-carrying liquid injection passage, wherein the particle-carrying liquid carries the anti-channeling flow pack-off particles into the annular space and the clearance;

sealing: sealing the particle-carrying liquid injection passage or closing a communicating portion between the particle-carrying liquid injection passage and the annular space; and establishing a flowing channel before the step of running the flow-control filter string by forming on the sand control screen, at least one flowing channel allowing the particle-carrying liquid carrying the anti-channeling flow pack-off particles to enter the clearance from the annular space or directly through the particle-carrying liquid injection passage.

2. The segmental flow-control method for the flow-control filter string according to claim 1, wherein the anti-channeling flow pack-off particles entering the annular space and clearance accumulate in, completely fill the annular space and the clearance.

3. The segmental flow-control method for the flow-control filter string according to claim 1, wherein the particle-carrying liquid injection passage is an annular space between an upper portion of the flow-control filter string and the sand control screen.

4. The segmental flow-control method for the flow-control filter string according to claim 1, wherein a packer is provided on top of the upper portion of the flow-control filter string for hanging the flow-control filter string, and wherein the particle-carrying liquid injection passage is a passage which is in the packer or around the packer and not closed during injection of the particle-carrying liquid so as to allow the particle-carrying liquid to flow therethrough.

5. The segmental flow-control method for the flow-control filter string according to claim 1, wherein under the circumstances that the flow-control filter string is run into the sand control screen by a run-in string, the segmental flow-control method for the flow-control filter string further comprises: after the sealing step, disconnecting the run-in string connected to the flow-control filter string so as to form a completion well structure wherein the anti-channeling flow pack-off particles fill the annular space and the clearance.

6. The segmental flow-control method for the flow-control filter string according to claim 1, wherein a true particle density of the anti-channeling flow pack-off particles is close to a density of the particle-carrying liquid so that the anti-channeling flow pack-off particles are adapted to be carried by the particle-carrying liquid into the clearance.

7. The segmental flow-control method for the flow-control filter string according to claim 1, wherein the true particle density of the anti-channeling flow pack-off particles is any value in a range from 0.4 g/cm$^3$ greater than a density of the particle-carrying liquid to 0.4 g/cm$^3$ less than a density of the particle-carrying liquid.

8. The segmental flow-control method for the flow-control filter string according to claim 7, wherein the true particle density of the anti-channeling flow pack-off particles is any value in a range from 0.2 g/cm$^3$ greater than the density of the particle-carrying liquid to 0.2 g/cm$^3$ less than the density of the particle-carrying liquid.

9. The segmental flow-control method for the flow-control filter string according to claim 1, wherein the particle-carrying liquid carrying the anti-channeling flow pack-off particles is water or aqueous solution.

10. The segmental flow-control method for the flow-control filter string according to claim 1, wherein the anti-channeling flow pack-off particles comprise macromolecular polymer particles having an average particle size of 0.05-1.0 mm and a true particle density of 0.8-1.4 g/cm$^3$.

11. The segmental flow-control method for the flow-control filter string according to claim 10, wherein the anti-channeling flow pack-off particles comprise macromolecular polymer particles having an average particle size of 0.1-0.5 mm and a true particle density of 0.94-1.06 g/cm$^3$.

12. The segmental flow-control method for the flow-control filter string according to claim 10, wherein the anti-channeling flow pack-off particles comprise high-density polyethylene particles having an average particle size of 0.1-0.5 mm and a true particle density of 0.90-0.98 g/cm$^3$.

13. The segmental flow-control method for the flow-control filter string according to claim 10, wherein the anti-channeling flow pack-off particles comprise styrene divinylbenzene crosslink copolymer particles having an average particle size of 0.05-1.0 mm and a true particle density of 0.96-1.06 g/cm$^3$.

14. The segmental flow-control method for the flow-control filter string according to claim 10, wherein the anti-channeling flow pack-off particles comprise polypropylene and polyvinyl chloride macromolecular polymer particles having an average particle size of 0.05-1.0 mm and a true particle density of 0.8-1.2 g/cm$^3$.

15. The segmental flow-control method for the flow-control filter string according to claim 1, wherein the step of establishing the flowing channel comprises drilling on the sand control screen at least one flowing channel in the form of a through hole by a sidetrack drilling method to help the particle-carrying liquid carrying the anti-channeling flow pack-off particles to enter the clearance from the annular space.

16. The segmental flow-control method for the flow-control filter string according to claim 1, wherein the step of establishing the flowing channel comprises perforating on the sand control screen at least one flowing channel in the form of a through hole by a perforating method to help the particle-carrying liquid carrying the anti-channeling flow pack-off particles to enter the clearance from the annular space.

17. The segmental flow-control method for the flow-control filter string according to claim 1, wherein the step of establishing the flowing channel comprises unsetting the packer for hanging the sand control screen to form at the packer a channel facilitating the particle-carrying liquid carrying the anti-channeling flow pack-off particles to enter the clearance directly through the particle-carrying liquid injection passage, and closing the packer after the annular space and the clearance are completely filled with the anti-channeling flow pack-off particles.

18. The segmental flow-control method for the flow-control filter string according to claim 1, wherein the sand control screen is a slotted screen, a sand control screen using a metal woven mesh as a filtering material, a punched slot screen, a wire wrapped screen, a metal powder or resin-sand grain sand control screen, a porous ceramic sand control screen, a metal cotton fiber sand control screen or a dual-layer pre-packed sand control screen.

19. An oil-gas well structure, comprising:

a well wall; and a sand control screen already run within the well wall, a clearance existing between the sand control screen and the well wall;

wherein a flow-control filter string is run into the sand control screen, the flow-control filter string is provided with flow-control filters, and an annular space is formed between the flow-control filter string and the sand control screen;

the annular space and the clearance are filled with the anti-channeling flow pack-off particles; and wherein the sand control screen is formed with at least one flowing channel in the form of a through hole allowing the particle-carrying liquid carrying the anti-channeling flow pack-off particles to pass therethrough.

20. The oil-gas well structure according to claim 19, wherein the anti-channeling flow pack-off particles completely fill the annular space and the clearance.

21. The oil-gas well structure according to claim 19, wherein the anti-channeling flow pack-off particles are carried by the particle-carrying liquid into the annular space and the clearance, and a true particle density of the anti-channeling flow pack-off particles is close to a density of the particle-carrying liquid so that the anti-channeling flow pack-off particles are adapted to be carried by the particle-carrying liquid into the clearance.

22. The oil-gas well structure according to claim 21, wherein the true particle density of the anti-channeling flow pack-off particles is any value in a range from 0.4 g/cm$^3$ greater than a density of the particle-carrying liquid to 0.4 g/cm$^3$ less than a density of the particle-carrying liquid.

23. The oil-gas well structure according to claim 22, wherein the true particle density of the anti-channeling flow pack-off particles is any value in a range from 0.2 g/cm$^3$ greater than the density of the particle-carrying liquid to 0.2 g/cm$^3$ less than the density of the particle-carrying liquid.

24. The oil-gas well structure according to claim 21, wherein the particle-carrying liquid carrying the anti-channeling flow pack-off particles is water or aqueous solution.

25. The oil-gas well structure according to claim 19, wherein the anti-channeling flow pack-off particles comprise macromolecular polymer particles having an average particle size of 0.05-1.0 mm and a true particle density of 0.8-1.4 g/cm$^3$.

26. The oil-gas well structure according to claim 25, wherein the anti-channeling flow pack-off particles comprise macromolecular polymer particles having an average particle size of 0.1-0.5 mm and a true particle density of 0.94-1.06 g/cm$^3$.

27. The oil-gas well structure according to claim 25, wherein the anti-channeling flow pack-off particles comprise high-density polyethylene particles having an average particle size of 0.1-0.5 mm and a true particle density of 0.90-0.98 g/cm$^3$.

28. The oil-gas well structure according to claim 25, wherein the anti-channeling flow pack-off particles comprise styrene divinylbenzene crosslink copolymer particles having an average particle size of 0.05-1.0 mm and a true particle density of 0.96-1.06 g/cm$^3$.

29. The oil-gas well structure according to claim 25, wherein the anti-channeling flow pack-off particles comprise polypropylene and polyvinyl chloride macromolecular polymer particles having an average particle size of 0.05-1.0 mm and a true particle density of 0.8-1.2 g/cm$^3$.

30. A segmental flow-control method for a flow-control filter string in an oil-gas well having a sand control screen, wherein the oil-gas well having the sand control screen comprises a well wall and a sand control screen already run within the well wall, one end of the sand control screen adjacent to a well mouth is fixed to the well wall, and an annular clearance is formed between the sand control screen and the well wall;

the segmental flow-control method for the flow-control filter string comprises the following steps:

1) establishing a channel: forming on the sand control screen at least one flowing channel allowing the particle-carrying liquid carrying the anti-channeling flow pack-off particles to pass therethrough;

2) running the flow-control filter string: running one flow-control filter string into the sand control screen by a run-in string, wherein the flow-control filter string is provided with at least two flow-control filters, and an annular space is formed between the flow-control filter string and the sand control screen;

3) filling with anti-channeling flow pack-off particles: injecting the particle-carrying liquid carrying the anti-channeling flow pack-off particles into the annular space between the flow-control filter string and the sand control screen; the particle-carrying liquid carries the anti-channeling flow pack-off particles simultaneously into the annular space between the flow-control filter string and the sand control screen and the annular clearance between the sand control screen and the well wall, and the anti-channeling flow pack-off particles simultaneously accumulate in, completely fill the annular space between the flow-control filter string and the sand control screen and the annular clearance between the sand control screen and the well wall;

4) sealing: sealing at the end adjacent to the well mouth the annular space which is between the flow-control filter string and the sand control screen and completely filled with the anti-channeling flow pack-off particles;

5) disconnecting the run-in string connected to the flow-control filter string, thereby forming a completion well structure wherein both the annular space between the flow-control filter string and the sand control screen and the annular clearance between the sand control screen and the well wall are completely filled with the anti-channeling flow pack-off particles.

31. The segmental flow-control method for the flow-control filter string in the oil-gas well having the sand control screen according to claim 30, wherein the step of establishing the channel comprises drilling on the sand control screen at least one through hole by a sidetrack drilling method to help the particle-carrying liquid carrying the anti-channeling flow pack-off particles to pass therethrough.

32. The segmental flow-control method for the flow-control filter string in the oil-gas well having the sand control screen according to claim 30, wherein the step of establishing the channel comprises perforating at least one through hole in the sand control screen by a perforating method to help the particle-carrying liquid carrying the anti-channeling flow pack-off particles to pass therethrough.

33. The segmental flow-control method for the flow-control filter string in the oil-gas well having the sand control screen according to claim 30, wherein the step of establishing the channel comprises unsetting the packer for hanging the sand control screen to form at the packer hanging the sand control screen a channel facilitating the particle-carrying liquid carrying the anti-channeling flow pack-off particles to pass therethrough; after the anti-channeling flow pack-off particles completely fill the annular space between the flow-control filter string and the sand control screen and the annular clearance between the sand control screen and the well wall, the packer hanging the sand control screen is closed.

34. The segmental flow-control method for the flow-control filter string in the oil-gas well having the sand control screen according to claim 30, wherein the sand control screen is a slotted screen, a sand control screen using a metal woven mesh as a filtering material, a punched slot screen, a wire wrapped screen, a metal powder or resin-sand grain sand control screen, a porous ceramic sand control screen, a metal cotton fiber sand control screen or a dual-layer pre-packed sand control screen.

35. The segmental flow-control method for the flow-control filter string in the oil-gas well having the sand control screen according to claim 34, wherein the particle-carrying liquid carrying the anti-channeling flow pack-off particles is water or aqueous solution.

36. The segmental flow-control method for the flow-control filter string in the oil-gas well having the sand control screen according to claim 35, wherein the anti-channeling flow pack-off particles comprise macromolecular polymer particles having an average particle size of 0.05-1.0 mm and a true particle density of 0.8-1.4 g/cm$^3$.

37. The segmental flow-control method for the flow-control filter string in the oil-gas well having the sand control screen according to claim 36, wherein the anti-channeling flow pack-off particles comprise macromolecular polymer particles having an average particle size of 0.1-0.5 mm and a true particle density of 0.94-1.06 g/cm$^3$.

38. The segmental flow-control method for the flow-control filter string in the oil-gas well having the sand control screen according to claim 36, wherein the anti-channeling flow pack-off particles comprise high-density polyethylene particles having an average particle size of 0.1-0.5 mm and a true particle density of 0.90-0.98 g/cm$^3$.

39. The segmental flow-control method for the flow-control filter string in the oil-gas well having the sand control screen according to claim 36, wherein the anti-channeling flow pack-off particles comprise styrene divinylbenzene crosslink copolymer particles having an average particle size of 0.05-1.0 mm and a true particle density of 0.96-1.06 g/cm$^3$.

40. The segmental flow-control method for the flow-control filter string in the oil-gas well having the sand control screen according to claim 36, wherein the anti-channeling flow pack-off particles comprise polypropylene and polyvinyl chloride macromolecular polymer particles having an average particle size of 0.05-1.0 mm and a true particle density of 0.8-1.2 g/cm3.

* * * * *